US010030897B1

(12) United States Patent
Song

(10) Patent No.: US 10,030,897 B1
(45) Date of Patent: Jul. 24, 2018

(54) HEAT EQUILIBRATION SYSTEM AND METHOD

(71) Applicant: SaeHeum Song, Skillman, NJ (US)

(72) Inventor: SaeHeum Song, Skillman, NJ (US)

( * ) Notice: Subject to any disclaimer, the term of this patent is extended or adjusted under 35 U.S.C. 154(b) by 391 days.

(21) Appl. No.: 14/830,905

(22) Filed: Aug. 20, 2015

Related U.S. Application Data

(60) Provisional application No. 62/092,834, filed on Dec. 17, 2014.

(51) Int. Cl.
*F25B 30/06* (2006.01)
*F28D 1/03* (2006.01)
*F25B 27/00* (2006.01)

(52) U.S. Cl.
CPC ..... *F25B 30/06* (2013.01); *F25B 27/00* (2013.01); *F28D 1/03* (2013.01)

(58) Field of Classification Search
CPC .... F25B 39/022; F25B 39/025; F25B 39/028; F28D 1/0417
See application file for complete search history.

(56) References Cited

U.S. PATENT DOCUMENTS

2006/0196052 A1* 9/2006 Lesage ..... B21D 53/085 29/890.043
2008/0029242 A1* 2/2008 Ben-Salha ..... F25B 9/008 165/42
2008/0105419 A1* 5/2008 Oh ..... F25B 39/022 165/173
2011/0067437 A1 3/2011 Song

* cited by examiner

*Primary Examiner* — Cassey D Bauer
(74) *Attorney, Agent, or Firm* — Arthur Jacob

(57) ABSTRACT

A heat equilibration system and method transfer heat between ambient air and a liquid heat exchange medium. Conduits have plate-like walls spaced apart by a small distance to contain a thin, film-like stream of liquid heat exchange medium and the conduits are spaced apart from one another to establish a path for exposure of the walls to ambient air. Liquid heat exchange medium is passed through each conduit, flowing in a thin, film-like stream to transfer heat between the ambient air and the liquid heat exchange medium. In one embodiment, the liquid heat exchange medium is water, circulated through a heat equilibration system and a water source heat pump.

12 Claims, 5 Drawing Sheets

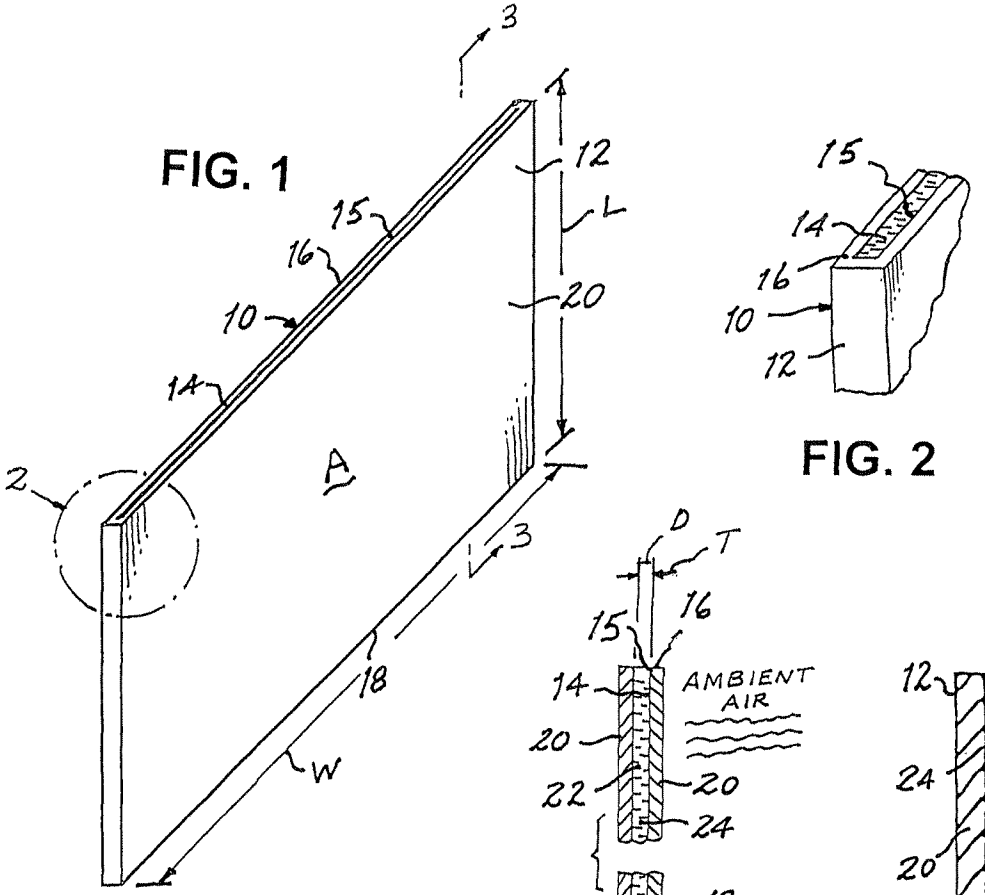
FIG. 1
FIG. 2
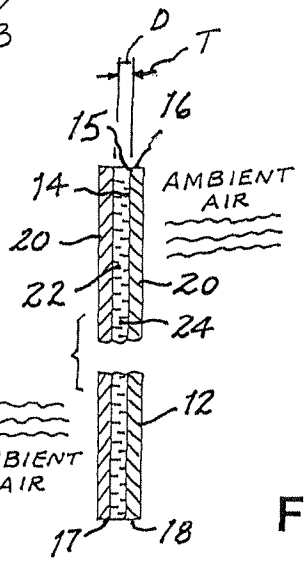
FIG. 3
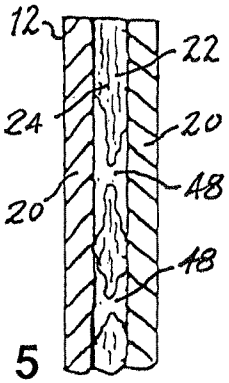
FIG. 5

HEAT EQUILIBRATION SYSTEM AND METHOD

This application claims the benefit of U.S. Provisional Patent Application Ser. No. 62/092,834, filed Dec. 17, 2014, the subject matter of which is incorporated herein by reference thereto.

The present invention relates generally to a system and method for maintaining a source of liquid heat exchange medium, preferably water, at a temperature equivalent to that of ambient air so as to enable use of a liquid heat exchange medium source heat pump in an installation in ambient air, and pertains, more specifically, to the configuration and use of a heat equilibration system and method in which a heat equilibrator unit includes conduits having a plate-like construction to provide a very large heat exchange surface area combined with a very limited thickness for conducting a film-like liquid heat exchange medium through the unit, thereby allowing rapid, almost immediate heat equilibrium with surrounding ambient air for use of the surrounding ambient air as a viable source of heat for a liquid heat exchange medium source heat pump in the system.

Air source heat pumps provide a convenient and low cost installation in systems that utilize a heat pump. However, use of an air source heat pump is limited due to critical balancing points and the need for frequent defrosting. On the other hand, water source heat pumps provide high efficiency at a wide range of entering water temperature, typically about 20° F. to 100° F. However, use of a water source heat pump is limited to the availability of a convenient water source, such as ground water, lakes, and rivers.

Most air source heat pumps exhibit a coefficient of performance (COP) of about 3 at 47° F., with the typical average COP over seasonal variations being in the range of 2.5 to 2.8. Water source heat pumps, on the other hand, typically exhibit a COP of 4 to 5, at an entering water temperature of about 40° F. to 50° F. In an area of mild to moderate climate, ambient temperature hardly ever falls below the freezing point. Therefore, the use of ambient air to regulate the temperature of water circulated in a system employing a water source heat pump will enable the use of a high efficiency water source heat pump in connection with an ambient air installation, without the need for a traditional water source. Such a measure would significantly lower the installation cost of a water source heat pump system while providing significantly increased efficiency.

The exchange of heat between ambient air and water within a container takes place through the surface area of the container wall. The time required to conduct the exchange of heat is inversely proportional to the total heat content and the thickness of the volume of water within the container, and is directly proportional to the total surface area and the heat conductivity of the container wall. Total heat content is the sum of heat in the water and in the material of the container wall. The present invention meets the challenge of minimizing water volume in a container and increasing container heat exchange surface area exposed to ambient air.

In an earlier disclosed system (US Published Patent Application No. 20110067437), a plurality of large containers, each container having a corresponding large surface area and containing a large volume of water, are utilized in connection with a water source heat pump. Upon exposure of the containers to ambient air, at least thirty minutes are required to bring the temperature of the contained water to that of the ambient air. Further, the disclosed system requires about sixty gallons of water per ton capacity of the heat pump operating at a 10° F. differential across the heat pump. That requirement mandates bulky outside units in order to conduct sufficient heat transfer between water in the system and ambient air. Accordingly there is a need for a system and method that will decrease significantly the time required to reach heat equilibrium between water in the system and ambient air.

Near immediate heat equilibrium between ambient air and water, or another liquid heat exchange medium, can be accomplished where heat exchange is conducted between ambient air and a limited volume of the liquid, contained within a large heat exchange surface area exposed to the ambient air. Large heat exchange surface area coupled with a limited volume of water can be achieved through utilization of a film thickness of water contained within a wide area containment wall. However, it is necessary to maintain a total volume of water sufficient to conduct effective heat exchange in a water source heat pump, while preventing film disruption during the flow of water in a film thickness stream. Film disruption, which can reduce effective heat transfer contact between the film of water and the containment wall, can be avoided by utilizing a thicker film; however, a thick film will delay heat exchange between the water and ambient air, thereby defeating the ability to attain rapid heat equilibrium between the water and ambient air. In addition, the added volume of water results in a concomitant added cost of the film material.

The present invention advantageously utilizes a liquid heat exchange medium in the form of a plurality of film thickness streams, preferably of water, falling un-pressurized through corresponding multiple conduits having walls providing large heat conductive surfaces exposed to ambient air for heat exchange between the streams and ambient air, without a risk of film disruption. The conduits extend between upper and lower reservatories which, in turn, are connected in a circulation arrangement to a water source heat pump, and at least the lower reservatory has a volume great enough to supply an amount of heat exchange medium sufficient to conduct heat exchange in the water source heat pump, thereby enabling the advantageous use of the more efficient water source heat pump in an ambient air installation. Thus, the present apparatus and method enable the use of a water source heat pump in an ambient air system to gain the benefits of using a high efficiency water source heat pump without the need for a costly and complex external water source.

The present invention will be understood more fully, while further objects and advantages will be apparent, in the following detailed description of preferred embodiments illustrated in the accompanying drawing, in which:

FIG. 1 is a largely schematic, isometric illustration of a component part of a heat equilibration system constructed in accordance with the present invention;

FIG. 2 is an enlarged, fragmentary view of a portion of the component part indicated by arrow 2 in FIG. 1;

FIG. 3 is an enlarged cross-sectional view taken along line 3-3 of FIG. 1;

FIG. 5 is a further enlarged cross-sectional view similar to a fragment of FIG. 3, but illustrating a disruption that is avoided by the present invention;

Figure 4:
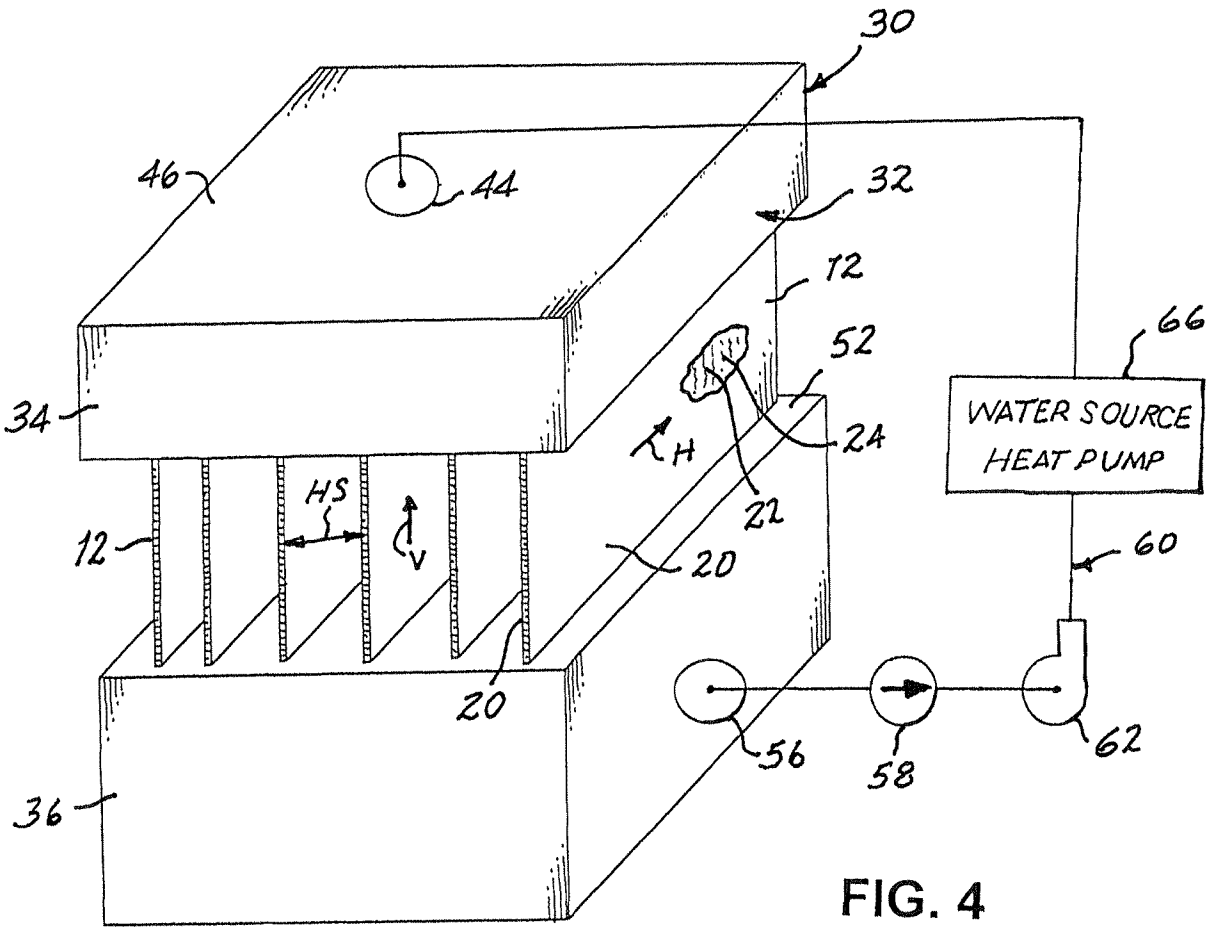
FIG. 4 is a largely diagrammatic illustration of the heat equilibration system.
Figure 7:
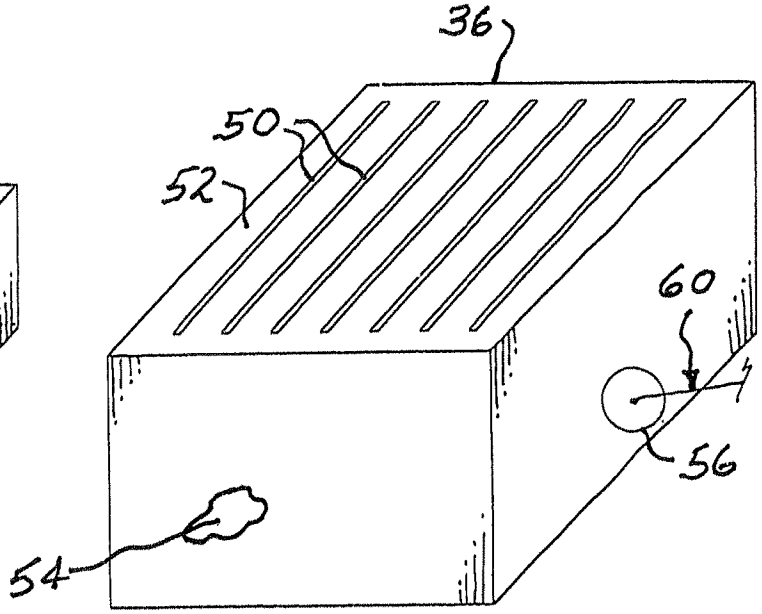
FIG. 7 is an isometric illustration of still another component part of the heat equilibration system.
Figure 6:
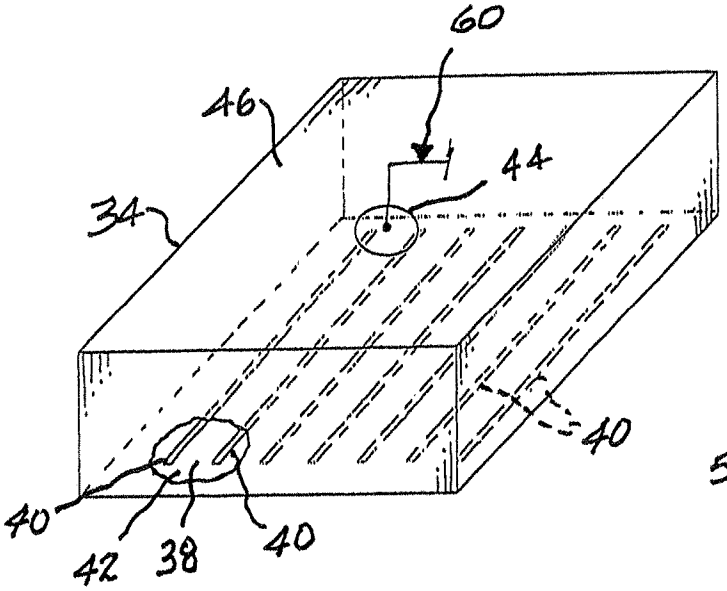
FIG. 6 is an isometric illustration of another component part of the heat equilibration system.

Referring now to the drawing, and especially to FIGS. 1 through 3 thereof, an exemplary individual heat equilibrator unit constructed in accordance with the present invention is shown at 10 and is seen to be in the form of a conduit 12 having a generally tubular construction that includes an inner passage 14 passing through the conduit 12 from an inlet 15 at open top 16 to an outlet 17 at open bottom 18. Opposite plate-like walls 20 are constructed of a material possessing high heat conductivity characteristics, and each wall 20 has a longitudinal length L and a lateral width W establishing a predetermined heat transfer area A. The walls 20 are spaced apart by a transverse distance D to provide the inner passage 14. In a preferred, exemplary construction, length L is about 40 cm., width W is about 30 cm. and distance D is about 1 mm., enabling the passage 14 to accommodate a stream 22 of liquid heat exchange medium having a thickness T of about 1 mm., flowing through conduit 12, along passage 14, from the top 16 to the bottom 18. These dimensions provide passage 14 with a cross-sectional area similar to that of a three-quarter inch circular pipe. The preferred medium is water, shown at 24, although other liquid heat exchange media, such as antifreeze and mixtures which might contain either water or antifreeze are feasible.

Turning now to FIGS. 4 through 7, with reference as well to FIGS. 1 through 3, conduits 12 are shown integrated into a heat equilibration system shown largely diagrammatically at 30. Heat equilibration system 30 includes a heat equilibrator unit 32 placed in ambient air and comprised of a plurality of conduits 12, oriented with each length L extending in a substantially vertical direction V and each width W extending in a substantially horizontal direction H. The conduits 12 extend from a first, upper reservatory shown in the form of upper receiver tank 34, to a second, lower reservatory shown in the form of lower supply tank 36. Conduits 12 are spaced apart from one another by a horizontal spacing HS to expose the walls 20 of each conduit 12 to surrounding ambient air, and each passage 14 communicates with the interior 38 of receiver tank 34 through a corresponding upper opening 40 in the bottom plate 42 of receiver tank 34. Water 24 is received in receiver tank 34 through an input valve 44 shown adjacent the top wall 46 of receiver tank 34 and is distributed to the conduits 12 by the upper openings 40 in bottom plate 42, bottom plate 42 serving in the manner of a header which distributes water 24 essentially evenly among the passages 14 of the conduits 12.

Water 24 then falls through passages 14 in a relatively thin, film-like stream 22, biased downwardly by gravity, and preferably without external pressure, such that stream 22 remains continuous and contiguous with the walls 20 of each conduit 12, as seen in FIG. 3; without a disruption that might otherwise occur, such as that illustrated in FIG. 5 wherein the stream 22 is shown to be broken and departed from walls 20 at random locations 48, which occurrence would adversely affect the total heat exchanged between water 24 and the surrounding ambient air during any given period of operation. The thin, film-like stream 22, as illustrated in FIG. 3, effects nearly immediate heat equilibrium between the water 24 in each stream 22 and ambient air surrounding the spaced-apart conduits 12. Each stream 22 then passes through a corresponding lower opening 50 in top plate 52 of supply tank 36 to enter the interior 54 of supply tank 36, top plate 52 serving in the manner of a header which spreads water 24 throughout the interior 54. The interior 54 of supply tank 36 is provided with a volume great enough to enable the accumulation of water 24 in an amount sufficient to operate the heat equilibration system 30, while allowing water 24 to fall, biased by gravity, from receiver tank 34, through conduits 12 and into supply tank 36, where water 24 is accumulated in the requisite amount.

During operation of the heat equilibration system 30, water 24 is conducted from supply tank 36, through an output valve 56 and a one-way valve 58, by a circulation system 60 that includes a water circulation pump 62. The water 24 from supply tank 36 is directed to a water source heat pump 66 and is returned from the heat pump 66 to the receiver tank 34, through the input valve 44. When operating in a heating mode, the temperature of the water 24 entering the receiver tank 34 is lower than the temperature of the ambient air surrounding the conduits 12, and heat is transferred from the ambient air to the streams 22 of water 24 passing through passages 14. When operating in a cooling mode, the temperature of the water 24 entering the receiver tank 34 is higher than the temperature of the ambient air surrounding the conduits 12, and heat is transferred from the streams 22 of water 24 passing through passages 14 to the ambient air surrounding the conduits 12. In either mode of operation, the temperature of the water 24 entering the supply tank 36 will become similar to the temperature of the ambient air surrounding the conduits 12 and the heat equilibration system 30 is prepared for the next operation. Thus, the heat equilibration system 30 provides water 24 to the water source heat pump 66 at the temperature of the ambient air present in the region of the installation, making it possible to gain the advantages provided by a water source heat pump in mild to moderate climate areas, without the need for a complex and costly water source. It is noted that although only one heat equilibrator unit 32 is utilized, as depicted in the illustrated embodiment, multiple units 32 may be incorporated into a single heat equilibration system 30, as required to conduct the operations set forth above.

Figure 8:
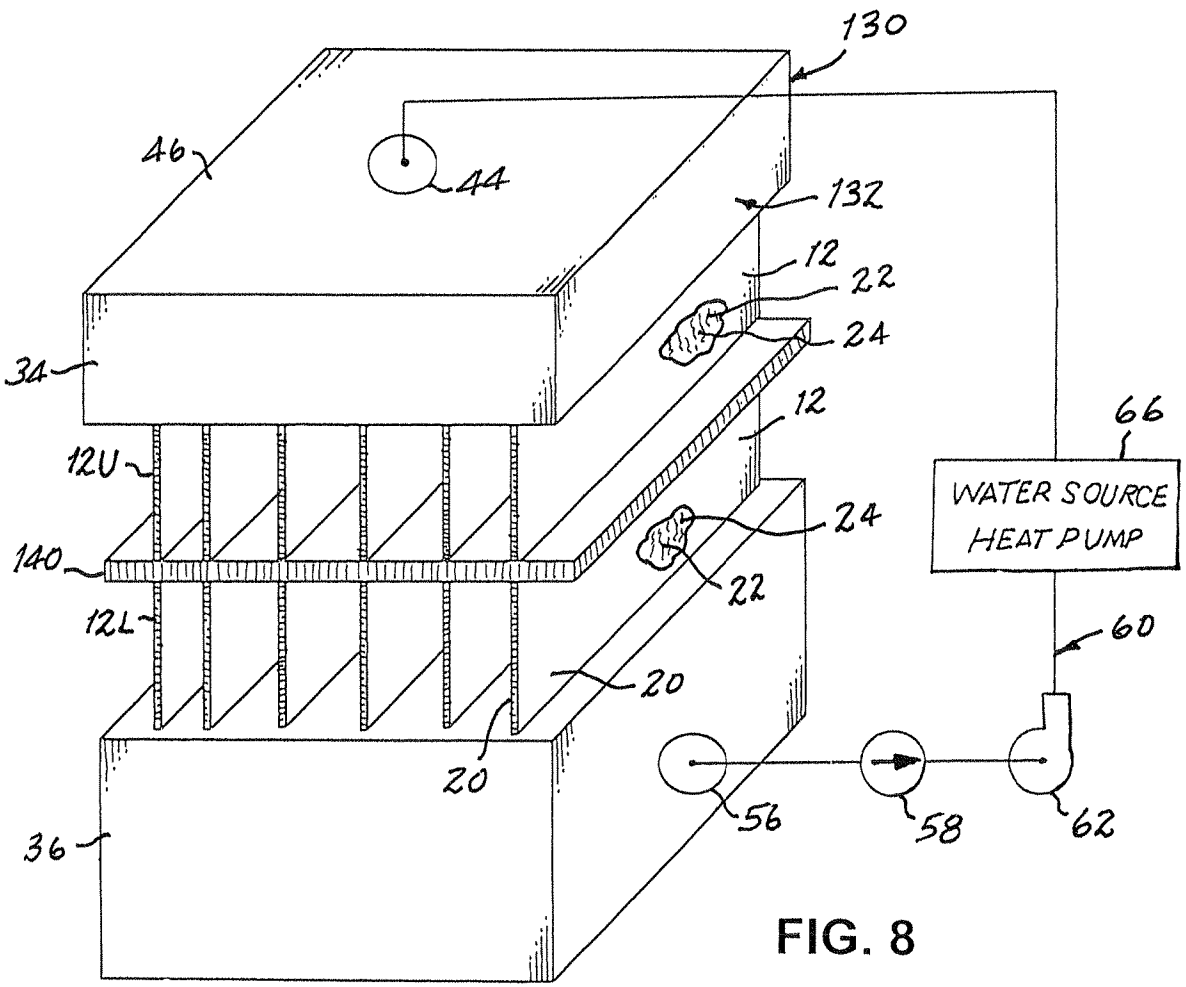
FIG. 8 is a largely diagrammatic illustration of another heat equilibration system constructed in accordance with the present invention.
Figure 9:
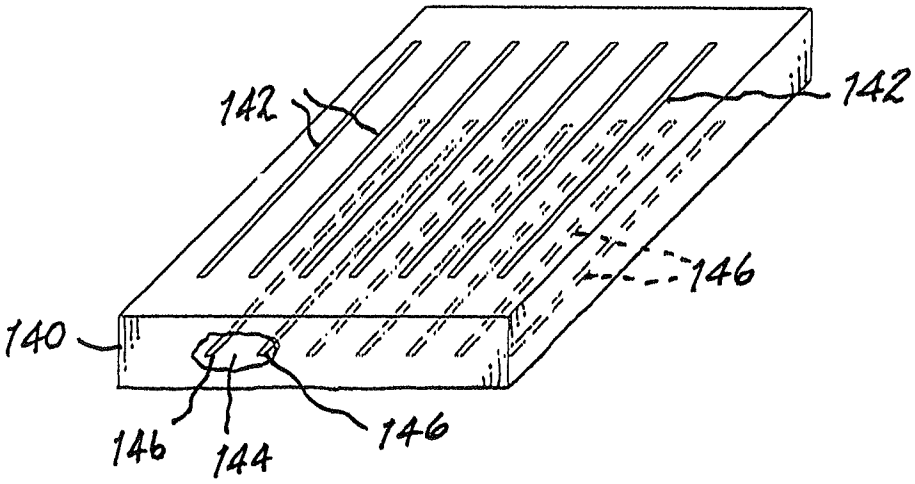
FIG. 9 is an isometric illustration of a component part of the heat equilibration system of FIG. 6.

Referring now to FIGS. 8 and 9, another embodiment of the present invention is illustrated in the form of a heat equilibration system shown largely diagrammatically at 130. Heat equilibration system 130 includes a heat equilibrator unit 132 placed in ambient air and constructed to operate in a similar manner to heat equilibrator unit 32. Accordingly, similar component parts are identified with the same reference characters as found in FIGS. 1 through 5, and these component part operate in the same manner as described above in connection with heat equilibration system 130 and heat equilibrator unit 32.

Thus, heat equilibrator unit 132 includes an intermediate reservatory, shown in the form of a transfer tank 140 located longitudinally between the receiver tank 34 and the supply tank 36. A plurality of conduits 12 include a first, upper section 12U extending between the transfer tank 140 and a second, lower section 12L extending between the transfer tank 140 and the supply tank 36. Water 24 flows in streams 22 through upper sections 12U into the transfer tank 140 through corresponding upper openings 142, is distributed throughout the interior 144 of transfer tank 140, and exits the interior 144 through lower openings 146 to enter corresponding lower sections 12L and proceed to supply tank 36.

The increased length of each conduit 12 resulting from the total length of the upper and lower sections 12U and 12L provides a concomitant increase in the total heat transfer area made available for the exchange of heat between the streams 22 of water 24 and the ambient air surrounding the conduits 12, without compromising the ability of the streams 22 to fall through the conduits 12 by gravity while resisting disruption of the streams 22, which disruption could adversely affect the ability of the streams 22 to remain contiguous with the walls 20 of the conduits 12 and effective in transferring heat between water 24 and the ambient air. Further, use of the transfer tank 140 assists in mixing the water 24 for a more even heat distribution, as the water 24 proceeds through the heat equilibrator unit 132. Moreover, the use of plural sections 12U and 12L in lieu of a single extra-long conduit 12 provides a higher degree of structural integrity.

It will be seen that the present invention attains the objects and advantages set forth above.

It is to be understood that the above detailed description of preferred embodiments of the invention is provided by way of example only. Various details of design, construction and procedure may be modified without departing from the true spirit and scope of the invention as set forth in the appended claims.

The embodiments of the invention in which an exclusive property or privilege is claimed are defined as follows:

1. A heat equilibration system for transferring heat between ambient air and a liquid heat exchange medium, the heat equilibration system comprising:

a plurality of conduits, each conduit being enclosed by at least two plate-like walls constructed of a material possessing high heat conducting characteristics, each wall having a longitudinal length and a lateral width establishing a predetermined heat transfer area;

the walls being spaced apart by a small transverse distance relative to the length and width of the walls, the small transverse distance being about 1 mm., such that the conduit is configured to contain a thin, film-like stream of liquid heat exchange medium;

each conduit including an inlet for admitting liquid heat exchange medium into the conduit; and an outlet for conducting liquid heat exchange medium out of the conduit;

a first reservatory communicating with each inlet;

a second reservatory communicating with each outlet; and the conduits being spaced apart from one another to establish a path for exposure of the walls to ambient air;

each conduit being oriented with the longitudinal length thereof extending in a substantially vertical direction and the width thereof extending in a substantially horizontal direction such that the second reservatory is located below the first reservatory, and liquid heat exchange medium will fall, in response to gravity, from the first reservatory, through each conduit, to the second reservatory;

whereby liquid heat exchange medium passing through each conduit, from the first reservatory to the second reservatory, will fall through each conduit in an established uninterrupted thin, film-like stream to transfer heat between the ambient air and the liquid heat exchange medium.

2. The heat equilibration system of claim 1 wherein each longitudinal length is about 40 cm., and each lateral width is about 30 cm.

3. The heat equilibration system of claim 1 wherein the liquid heat exchange medium is water.

4. The heat equilibration system of claim 1 including:

an intermediate reservatory located between the first and second reservatories;

each conduit having a first section extending between a corresponding inlet and the intermediate reservatory, and a second section extending between the intermediate reservatory and a corresponding outlet;

the intermediate reservatory communicating with each first section through a corresponding entrance, and communicating with each second section through a corresponding exit, such that liquid heat exchange medium will flow from the first reservatory, through each first section, to the intermediate reservatory, and from the intermediate reservatory, thorough each second section, to the second reservatory.

5. The heat equilibration system of claim 4 wherein the liquid heat exchange medium is water.

6. The heat equilibration system of claim 1 including:

a liquid heat exchange medium source heat pump; and a circulation arrangement for conducting the liquid heat exchange medium from the second reservatory to the heat pump and returning the liquid heat exchange medium from the heat pump to the first reservatory.

7. The heat equilibration system of claim 6 wherein the liquid heat exchange medium is water and the heat pump is a water source heat pump.

8. The heat equilibration system of claim 4 including:

a liquid heat exchange medium source heat pump; and a circulation arrangement for conducting the liquid heat exchange medium from the second reservatory to the heat pump and returning the liquid heat exchange medium from the heat pump to the first reservatory.

9. The heat equilibration system of claim 8 wherein the liquid heat exchange medium is water and the heat pump is a water source heat pump.

10. A method for transferring usable heat between ambient air and a liquid heat exchange medium, the method comprising:

providing a plurality of conduits, each conduit being enclosed by at least two plate-like walls constructed of a material possessing high heat conducting characteristics, each wall having a longitudinal length and a lateral width establishing a predetermined heat transfer area;

spacing the walls apart by a small transverse distance relative to the length and width of the walls, the small transverse distance being about 1 mm., such that the conduit is configured to contain a thin, film-like volume of liquid heat exchange medium;

admitting liquid heat exchange medium from a first reservatory into each conduit; and conducting liquid heat exchange medium out of each conduit and into a second reservatory;

orienting each conduit with the longitudinal length thereof extending in a substantially vertical direction and the width thereof extending in a substantially horizontal direction such that the liquid heat exchange medium will fall, in response to gravity, from the first reservatory, through each conduit, to the second reservatory; and spacing the conduits apart from one another to establish a path for exposure of the walls to ambient air;

whereby liquid heat exchange medium passing through each conduit, from the first reservatory to the second reservatory, will flow fall through each conduit in an established uninterrupted, thin, film-like stream to transfer heat between the ambient air and the liquid heat exchange medium.

11. The method of claim 10 including circulating the liquid heat exchange medium from the second reservatory to a liquid heat exchange medium heat pump, and returning the liquid heat exchange medium from the heat pump to the first reservatory.

12. The method of claim 11 wherein the liquid heat exchange medium is water and the heat pump is a water source heat pump.

* * * * *